US005330134A

United States Patent [19]

Ehrlich

[11] Patent Number: 5,330,134

[45] Date of Patent: Jul. 19, 1994

[54] RAILWAY CAB SIGNAL

[75] Inventor: Anthony G. Ehrlich, Pittsburgh, Pa.

[73] Assignee: Union Switch & Signal Inc., Pittsburgh, Pa.

[21] Appl. No.: 882,605

[22] Filed: May 13, 1992

[51] Int. Cl.[5] ..... B61L 21/10; B61L 3/16

[52] U.S. Cl. ..... 246/34 R; 246/34 B; 340/825.18

[58] Field of Search ..... 246/34 R, 34 A, 34 B, 246/34 CT, 58, 59, 60, 62, 63 R, 63 C, 122 R; 340/825.18

[56] References Cited

U.S. PATENT DOCUMENTS

| | | | |
|---|---|---|---|
| 1,629,866 | 5/1927 | Grondahl et al. | 246/34 B X |
| 1,975,371 | 10/1934 | Place | 246/63 C X |
| 2,019,166 | 10/1935 | Whitelock | 246/8 |
| 2,029,396 | 2/1936 | Sorensen | 246/8 X |
| 2,043,740 | 6/1936 | Failor | 246/34 R |
| 2,129,313 | 9/1938 | Whitelock | 330/122 |
| 2,219,876 | 10/1940 | Sorensen | 246/34 R |
| 2,297,148 | 9/1942 | Hines | 246/34 R X |
| 2,348,525 | 5/1944 | Cravath | 246/34 R X |
| 2,828,363 | 3/1958 | Ray | 370/11 |
| 2,903,574 | 9/1959 | Rees | 246/34 R |
| 2,947,814 | 8/1960 | Haner, Jr. | 375/65 |
| 2,959,669 | 11/1960 | Thomson | 246/34 R |
| 2,993,116 | 7/1961 | Utt | 246/34 R |
| 3,021,506 | 2/1962 | Haner et al. | 340/825.18 |
| 3,333,096 | 7/1967 | Ohman et al. | 246/34 R |
| 3,715,669 | 2/1973 | LaForest | 246/34 B X |
| 3,946,972 | 3/1976 | Grundy | 246/34 CT |
| 3,955,785 | 5/1976 | Vermeulen et al. | 246/34 CT |
| 3,986,691 | 10/1976 | Ehrlich et al. | 246/34 R |
| 4,298,179 | 11/1981 | Gilcher | 246/34 R |
| 4,314,306 | 2/1982 | Darrow | 246/34 CT X |
| 4,392,626 | 7/1983 | Pascoe | 246/34 R |
| 4,432,517 | 2/1984 | Ripamonti | 246/34 B X |
| 4,487,385 | 12/1984 | Salmon | 246/34 R |
| 4,535,959 | 8/1985 | Gilcher | 246/34 R |
| 4,641,803 | 2/1987 | Brown et al. | 246/34 CT |

*Primary Examiner*—Michael S. Huppert
*Assistant Examiner*—Scott L. Lowe
*Attorney, Agent, or Firm*—Buchanan Ingersoll

[57] ABSTRACT

An improved railway cab signal transmitter for transmitting a cab signal onto a pair of rails for reception by a railway vehicle on said rails. A tuning arrangement is connected across the rails to generally resonate with the leaving end impedance bond at a preselected cab signal frequency. The cab signal is coded at the preselected frequency such that the resonant circuit acts in conjunction with the code signal generation to act as a constant current signal source feeding the rails. A reduction in the maximum cab signal rail current is achieved thereby mitigating runby cab signal currents which might be available for reception by following trains. Embodiments of the tuning arrangement use a capacitor on the primary winding of the feed transformer. Other embodiments include inductance in series with a capacitor. Receivers for wayside displays that also use the cab signal current include embodiments having a capacitor or a capacitor/inductor across the wayside receiver transmitter secondary.

18 Claims, 7 Drawing Sheets

RAILWAY CAB SIGNAL

BACKGROUND OF THE INVENTION

While automatic block signal systems using wayside signals provide the primary control for railway vehicle operation, it is often desirable to have on-board signals to show track operating conditions. On-board, or cab signals, are particularly useful where rain, fog, or other environmental conditions make it difficult to see the wayside signal aspect. In addition, cab based signal displays permit a railway vehicle operator to monitor changing track conditions after the train has entered a block. Without cab signaling the train may only be permitted to proceed at a restricted speed, even if the block has now been cleared.

Cab signaling is well-known and has been used for many years with a transmitter applying a signal to the rails, and a railway vehicle mounted receiver inductively receiving the coded signal through two receiver coils mounted on the locomotive ahead of the leading wheels. The rail current between the transmitter and the leading axle is inductively sensed by the railway vehicle receiver and the appropriate signal is displayed in the vehicle cab.

When a train crosses the joints at the entering end of an unoccupied track circuit, its cab signal receiver will begin to sense the coded cab signal current in the rails immediately ahead of the leading axle. As the train proceeds through the track circuit, the level of this signal gets progressively higher as the rail impedance between the signal source and the train decreases. In track circuits the rail current can be as high as 20 amperes when the train reaches the leaving end, whereas the amount required to energize the cab receiver may be as low as 1.3 amperes. While the rail current is being sensed in advance of the leading axle, a certain amount of the track current that carries the cab signal is shunted through the railway vehicle wheel and axle assemblies, often referred to as the train shunt. If the impedance of the train shunt is above zero, even by as little as a few hundredths of an ohm, enough cab signal rail current may bypass the train to cause pickup of the cab signals by the receiver of a following train. This bypass cab signal current, referred to as runby, can, if sufficiently large, cause a second or following train to erroneously detect the clear signal intended for the lead train. Because the rail impedance and the ballast between the trains act to reduce the level of current reaching the following train, the problem of bypass current is particularly bothersome when the following train is in relatively close proximity to the lead train. In this condition, a substantial portion of the bypass current from the lead train is available to be sensed by the following train, and is highly undesirable.

SUMMARY OF THE INVENTION

Cab signal transmitters must provide sufficient output to be reliably sensed by the cab signal receiver at the furthest end of the train block, when the track circuit rail impedance and ballast conductance offer maximum suppression of signal transmission. When cab signal transmitters are adjusted upward to meet this condition they will inherently supply higher current as the train moves toward the leaving end, and the total rail impedance and ballast conductance ahead of it decrease. When the vehicle is directly upon the transmitter input the current can be limited by a resistor to a predetermined maximum current value. This, however, still results in high rail currents at the leaving end, since the amount of resistance usable is limited by the need to inject sufficient signal current into the track at minimum ballast resistance to reach the entering end which may be over a mile away from the leaving end. When trains are closely following each other at the leaving end, the following train has a higher chance of receiving an error signal from such high rail currents. This invention provides for a cab signaling transmitter which uses a constant current source to supply a reduced value of the coded cab signal to the rails. The level of current from the constant current source is selected to be the minimum value which will insure that a receiver in a vehicle at the entering end of the block will reliably detect the signal at minimum ballast resistance. One embodiment of the invention uses a capacitor in parallel arrangement with the impedance bond to form a resonant circuit such that the cab signal encoding means acts as a constant current coded signal source. A capacitor in series with the code voltage source is parallel tuned with the impedance bond to create a constant current transmitter.

To avoid high currents should the transmitter capacitor short or fail, an impedance such as an inductor can be added in series connection to the capacitor. The combined circuit of the capacitor, series inductor, and impedance bond can be tuned to resonate at the frequency of the coded cab signal and thereby provide a generally constant current cab signal transmitter.

During operation of the constant current cab signal transmitter the current fed to the rails remains constant and can be adjusted to a level sufficiently high to be initially sensed by an entering train. Ideally, the rail current which enters the track at the transmitter location remains constant for any condition of ballast leakage or any location of train. This current may be in the order of 7 amperes, as opposed to the much higher value — up to 20 amperes — which may flow in the prior art track circuits. Because this level of current is significantly less than in traditional track circuits, runby is correspondingly reduced.

In addition to mitigating runby of cab signals, the invention provides a saving in electrical energy through the use of the tuned track circuit. Because the high current levels in traditional track circuits where the train is in close proximity to the transmitter are avoided and the necessary higher signal voltage required to force such high level currents are not needed, lower overall voltage and currents are present in the circuit using the invention. In addition, since each tuned track circuit draws leading (capacitive) VA, whether occupied or unoccupied, the total load of all the track circuits on a property is in the direction of improving the power factor in the overall distribution system.

DESCRIPTION OF PRESENTLY PREFERRED EMBODIMENTS

Figure 1:
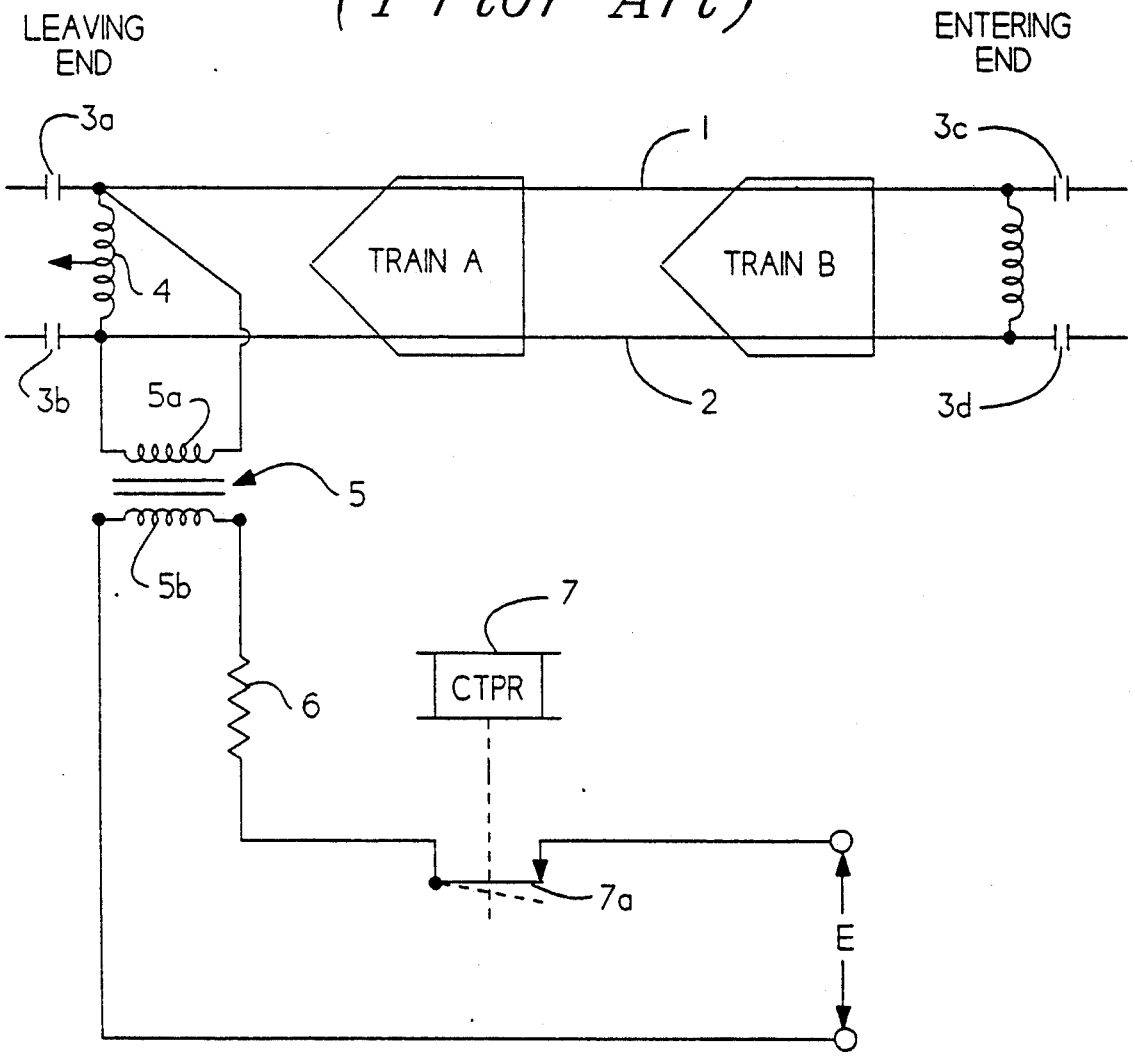
Fig.1. (Prior Art)
FIG. 1 is a drawing of a prior art cab signal transmitter and track circuit having a lead train "A" and a following train "B".

FIG. 1 shows a prior art railway cab signal transmitter which supplies a coded cab signal to rails 1 and 2. Rails 1 and 2 are part of a block separated from adjacent tracks at 3*a*–3*d*. The transmitter is attached to the rails at the leaving end of the block, which also contains impedance bond 4 shunting the rails 1 and 2. A feed transformer 5 having a secondary winding 5*a* connected across the rails and a primary winding 5*b* is also used. Connected to the primary winding 5*b* is a current limiting resistor 6, and a CTPR or code transmitter repeater 7. The CTPR has contacts 7*a* which alternately open and close to code the signal from the input voltage E. In this circuit CTPR and input E provide a means for generating a coded cab signal. Typically both trains A and B would have railway cab signal receivers on-board. The receivers are well-known and these devices do not form part of this invention. The on-board receivers generally sense the current in advance of the leading wheel and axle assembly on each respective train. This figure shows the trains diagrammatically; and as the expression "train" is often used in this specification, it is understood that the train may be a single locomotive or passenger transit vehicle. It may also be a multi-car freight, passenger, or transit consist. But, regardless of the type of vehicle, the cab signaling will usually occur at, or in advance of, the lead axles. The wheel and axle assemblies of the train provide electrical shunts between rails 1 and 2. As has been previously described, the voltage E and the value of resistor 6 are chosen such that the preceding train A can reliably sense the cab signal upon entering the block. As train A advances toward the leaving end, it does indeed shunt an appreciable amount of the rail current, but simultaneously the rail current will increase due to the fact that the rail impedance between the leaving end and the train is reduced.

Figure 2:
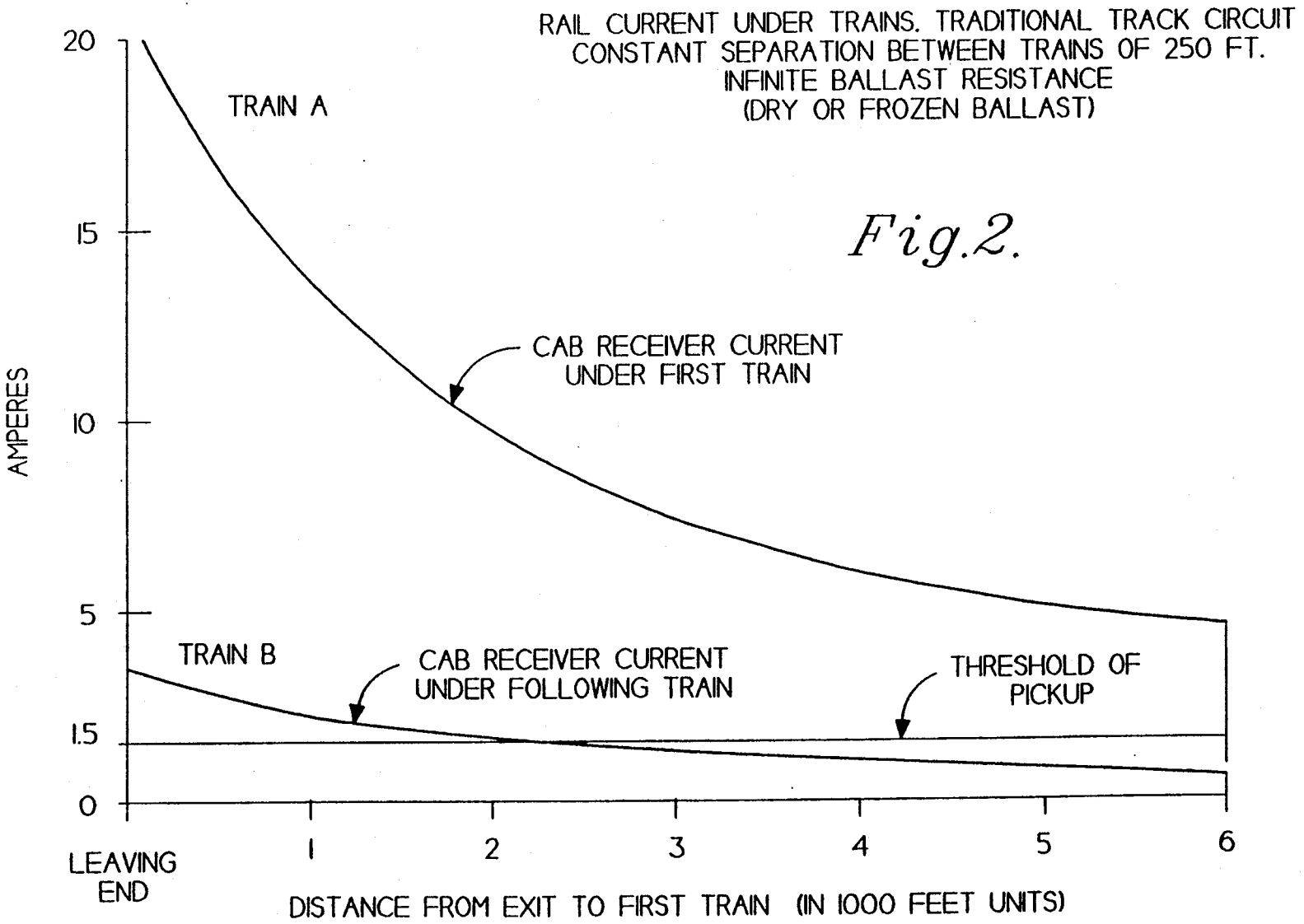
FIG. 2 is a representation of the rail current under trains "A" and "B" as shown in FIG. 1.

FIG. 2 shows the rail current that could be sensed by train A and train B as they move through the block. In this example the circuit parameters of the code signal transmitter of FIG. 1 have been adjusted to provide an entering end axle current of 2 amperes under minimum ballast resistance conditions of 3 ohms per thousand feet. The curves depict the current levels at infinite ballast resistance. This graph assumes that there is a constant separation between train A and train B of two hundred and fifty feet. As train A approaches the leaving end the current in the rails beneath it increases greatly. In this example 1.5 amperes has been assumed to be the minimum cab signal rail current necessary to be detected by the cab based receiver. It is clear that train A at all times can detect the cab signal. Upon entering the block, trailing train B cannot detect the cab signal because the runby coded cab signal rail current is less than 1.5 amperes. However, as train A approaches the 2500 foot distance from the leaving end sufficient rail runby current will bypass train A and be available to be sensed by train B. At this position (2500 feet) trailing train B will be able to detect the 1.5 amperes of runby cab signal. Train B in this example is behind train A by 250 feet and is erroneously able to detect a clear signal which is intended to be received only by train A. As train A is about to leave the block the cab receiver current available to train B is approximately 3.5 amperes. This undesirable condition permits train B to display in its cab the signal intended for train A. FIG. 2 also shows current in excess of 20 amperes in the rails as train A reaches the cab signal transmitter at the leaving end.

Figure 3A:
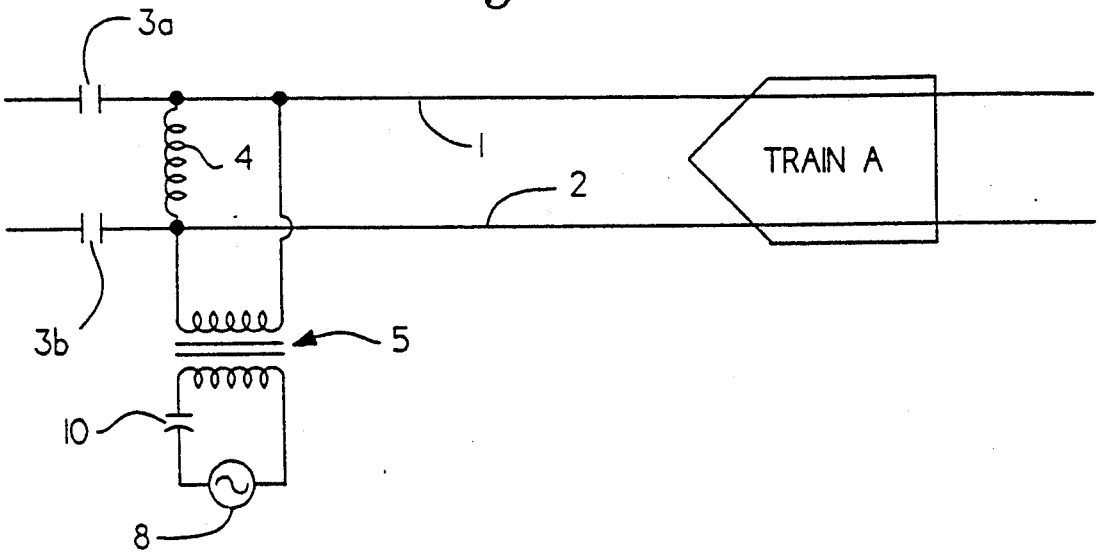
FIG. 3A is a diagrammatic representation of a presently preferred embodiment.
Figure 3B:
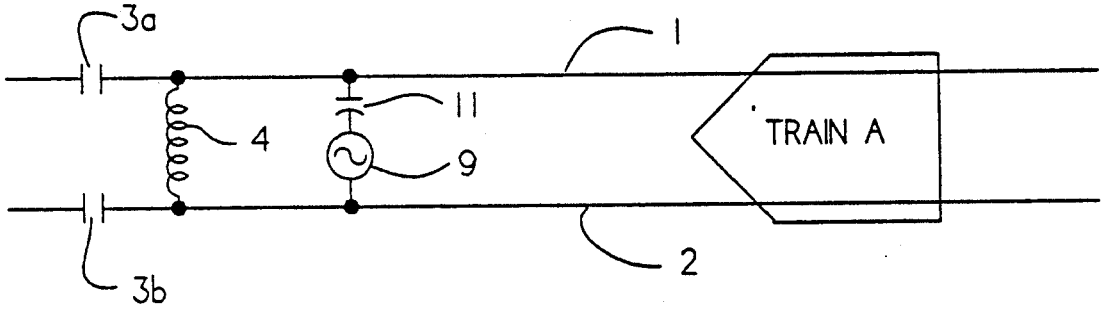
FIG. 3B is a diagrammatic representation showing an equivalent circuit of the embodiment of FIG. 3A without transformer 5.
Figure 3C:
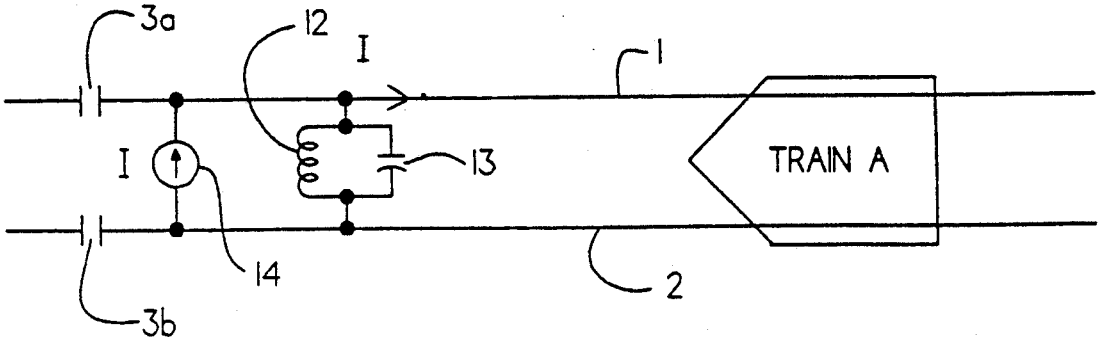
FIG. 3C is a diagrammatic equivalent of the circuit of FIG. 3B using a Norton's equivalent circuit.

FIG. 3A shows an improved cab signal transmitter circuit. Rails 1 and 2 have impedance bond 4 across the leaving end of a block. The cab signal is supplied to the rails via a transformer 5 having a capacitance 10 in series with the primary winding and a cab signal source 8. FIG. 3B shows an equivalent circuit in which appropriately valued capacitor 11 and voltage source 9 replace the components of FIG. 3A. While it will be desirable to use a transformer in most track circuits, the practice of this invention does not require that a feed transformer be used. Using inductance 4, capacitor 11, and voltage source 9 from FIG. 3B, Norton's theorem can be applied to yield another equivalent circuit as shown in FIG. 3C. In this equivalent circuit a constant current source 14 is applied to rails 1 and 2, and inductance 12 and capacitance 13 are in parallel resonance across the rails and thus draw no current from the source. The result of FIG. 3C is that current, I, from constant current source 14 is now applied directly to the rails 1 and 2. Rail current will ideally be equal to I regardless of the load implied by train A or the ballast. As train A enters the block in FIG. 3C the current which is available in the rail at the feed end for reception by the cab based receiver will be a constant and will remain constant as the train traverses the block. The current I can be chosen at a level such that a reliable cab signal current can be sensed in the vehicle receiver at the entering end under minimum ballast conditions. Then as the train A proceeds to the leaving end, the current injected into the track will remain the same and only a reduction in ballast current will cause an increase in the cab signal current available to train A. The result is that the current in the rail at the leaving end will not increase exponentially as in FIG. 2. Because this level of current has been chosen to be the minimum required for an entering train at minimum ballast resistance, the runby current available to following trains will be minimal.

Figure 4:
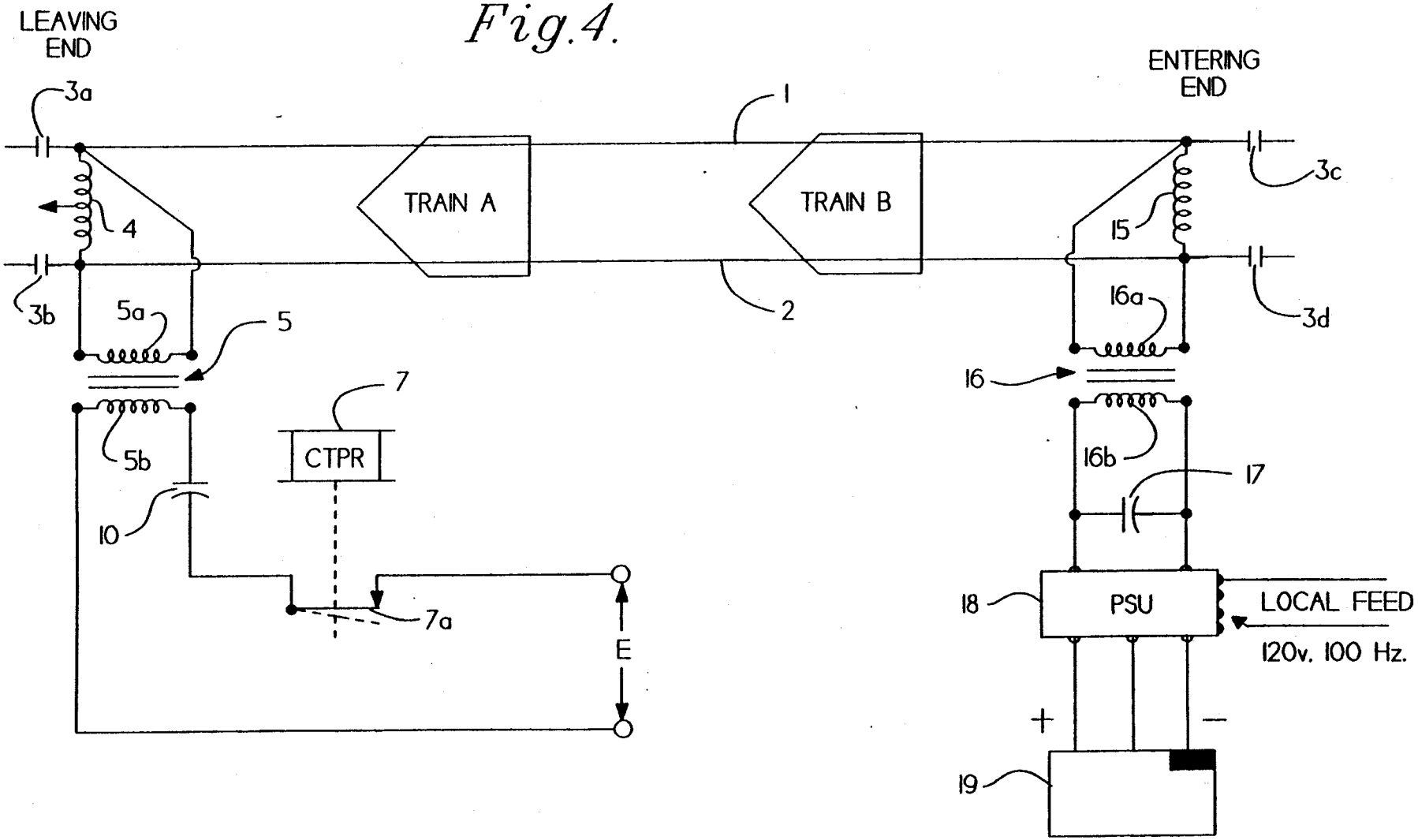
FIG. 4 is a presently preferred embodiment showing a lead train A, and a following train B, and showing a wayside track receiver on the entering end of the track block.

Referring to FIG. 4 shows a track circuit having a cab signal transmitter at the leaving end and a wayside signal receiver at the entering end, with trains A and B on rails 1 and 2. The cab signal transmitter transformer 5 has a primary 5*b* and a secondary 5*a*. Secondary 5*a* is connected across impedance bond 4. Capacitor 10 is in series with the primary winding 5*b*. A CTPR or code transmitter repeater 7 is shown in series with voltage source E. Voltage source E and CTPR create a means for supplying a coded cab signal which is fed to capacitor 10 and primary winding 5*b*. This signal is applied to the rails through transformer 5. As previously outlined, the value of capacitance 10 has been chosen with regard to the impedance of bond 4 and turns ratio of transformer 5 so as to cause the circuit combination to be in parallel resonance at the cab signal frequency. As such the Norton equivalent shows that the circuit acts as a constant current source.

Figure 5:
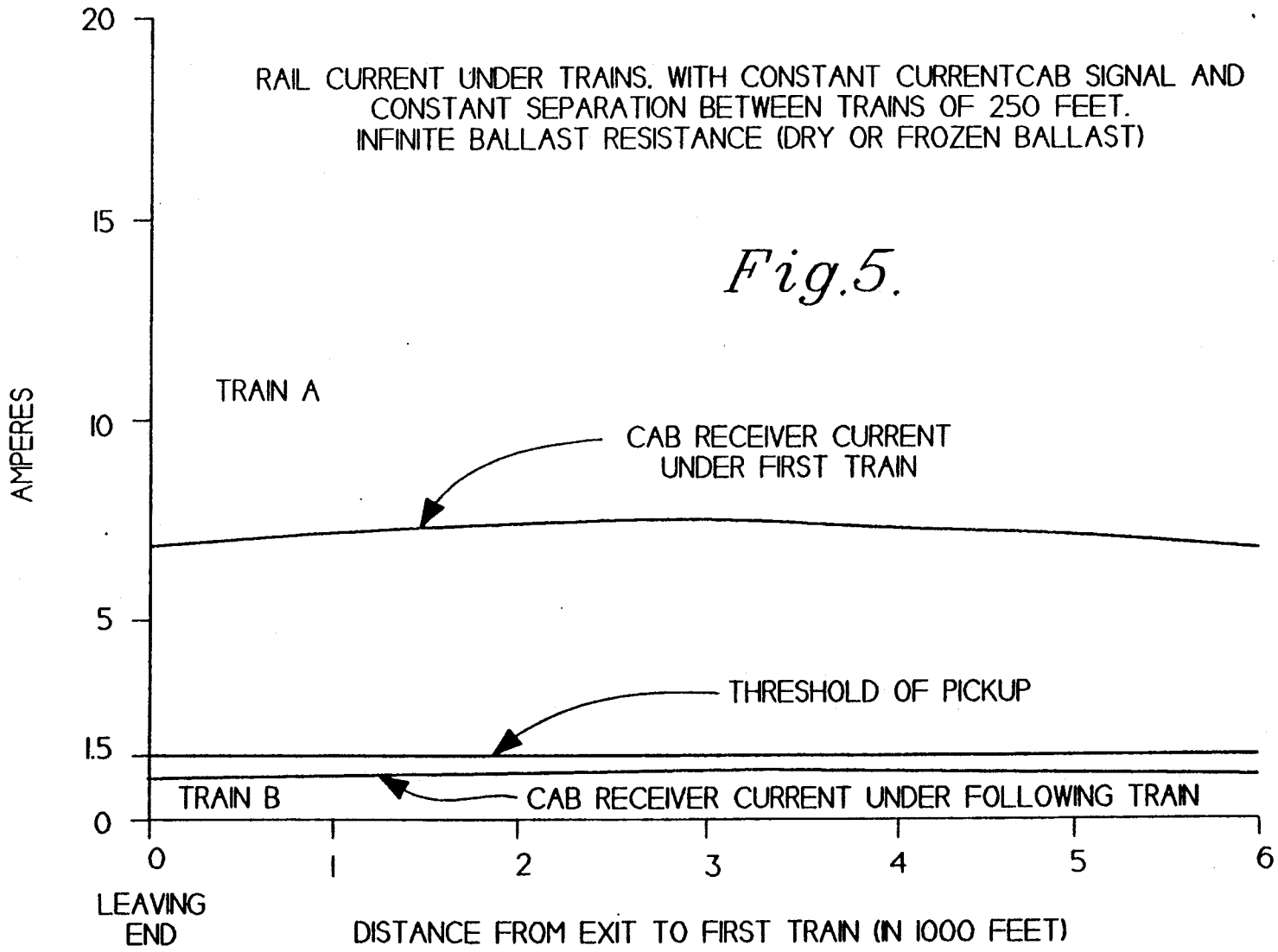
FIG. 5 shows the rail current under the trains "A" and "B" as shown in FIG. 4.

FIG. 5 shows the rail currents under the trains of FIG. 4 with the constant current cab signal and a constant separation between trains of 250 feet. Upon entering the block of FIG. 4 train A has approximately 7 amperes of current available for the cab signal receiver. Train B which is following would have only 1 ampere at the same entering position, or less than the 1.5 amperes necessary for it to sense the cab signals. As train A proceeds through the block to the leaving end the current remains substantially level. Because the current available to train A remains generally constant due to the ballast resistance being infinite (a worst case assumption), and train A's shunting effect remains constant, the amount of bypass current available for train B to sense also remains relatively constant and stays under the 1.5 amperes necessary for the receiver in train B to detect a cab signal. In comparing FIGS. 2 and 5 it is apparent that not only is a more reliable signal provided by the invention, but in addition the large currents and associated power surges in FIG. 2 are eliminated by the invention.

While capacitor 10 has been shown to be on the primary winding 5*b* side of transformer 5, it is to be understood that a capacitor could likewise be used instead on the secondary winding 5*a* side of transformer 5. The value of such capacitor on the secondary side would necessarily be increased because of the turns ratio of transformer 5. Based upon an impedance bond, 4, having an impedance of 1 ohm with a power factor angle of 80 degrees, a typical value for capacitor 10 would be approximately 15 microfarads assuming a power factor angle of minus 90 degrees. Track lead resistance is taken to be approximately 0.1 ohm including the winding resistances of the transformer 5. The track circuit is assumed to be six thousand feet long with a minimum ballast resistance of 3 ohms per thousand feet.

Considering the receiver on the entering end of the block shown in FIG. 4, the same feed voltage E must operate the Phase Selective Unit 18 and the cab signal equipment. The Phase Selective Unit as used herein is described in U.S. Pat. Nos. 2,884,516 and 3,986,691, and units such as Union Switch & Signal Inc. No. N451590-0101, could be used. The output of the Phase Selective Unit is fed to a track relay 19 such as the code follower relay shown. Track relay 19 may be either style CDP or style PC-250P as supplied by Union Switch & Signal Inc. or other equivalent known track relays. Because the characteristics of the apparatus of the wayside signal require a higher voltage than does the cab based equipment, the feed voltage E must be adjusted accordingly. This means that the cab signals will of necessity be over energized, thus adding to the runby problem. In order to minimize this effect it is desirable to reduce the feed voltage requirement of the Phase Selective Unit. For this reason the capacitor 17 is added at the entering receiver.

When the first train A clears the track circuit at the leaving end, the cab signals of the following train B are immediately reset because the rail current retains the value it had when the first train was still present and train A's shunt effect is removed. If the operating frequency of the Phase Selective Unit track circuit is 200 hertz, as is sometimes the case, then separate feed voltages are supplied for the Phase Selective Unit and the 100 hertz cab unit. This allows the cab signal to be set for just what is needed for the vehicle based receiver rather than what may be necessary for the wayside based receiver. When separate operating frequencies are used for the wayside and the cab signal then the capacitor 17 may be omitted.

Figure 6:
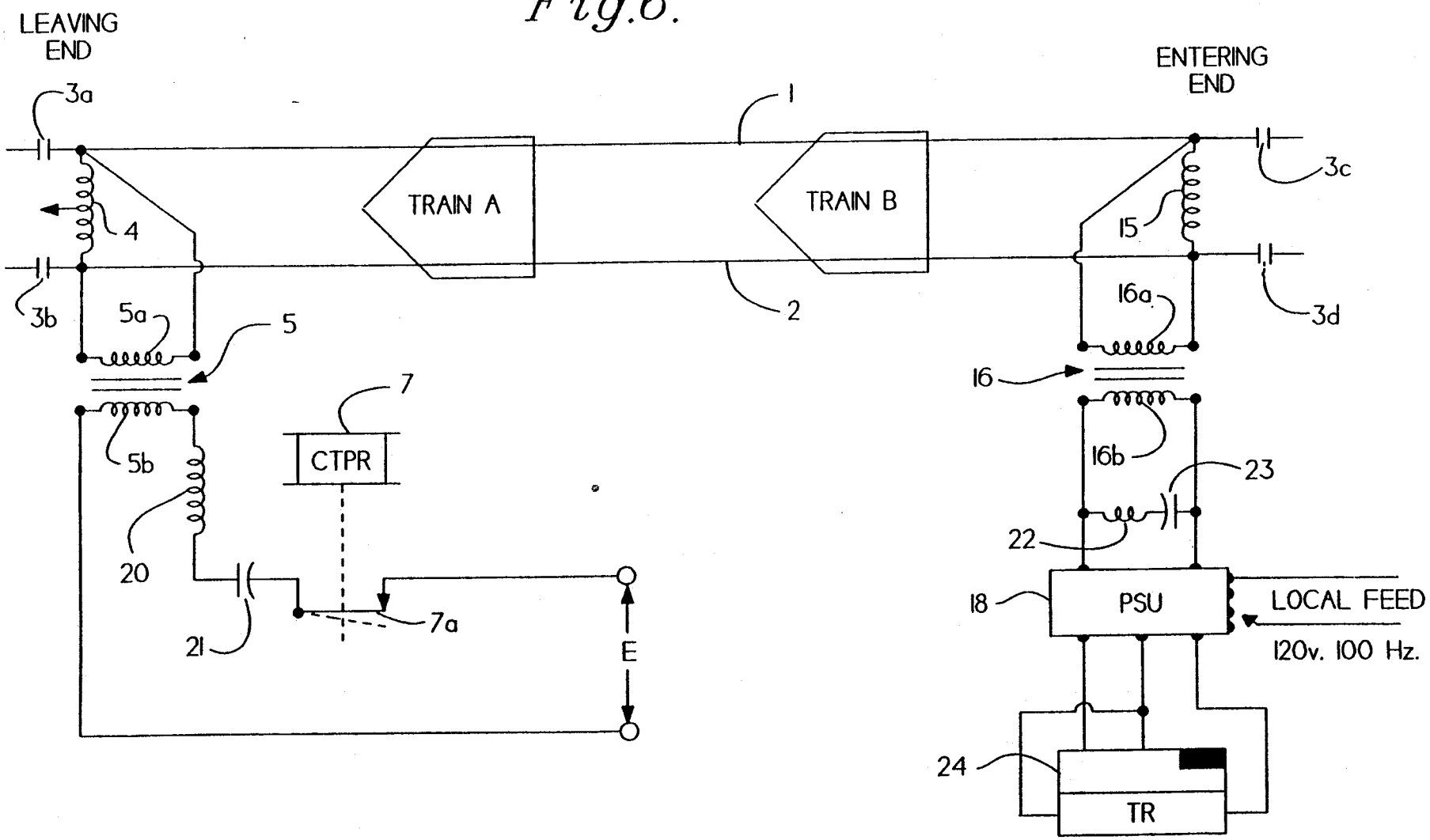
FIG. 6 is another presently preferred embodiment similar to that shown in FIG. 4 and having inductors in series with the transmitter capacitor and the receiver capacitor.

Referring now to FIG. 6, a circuit is shown which is similar to that shown in FIG. 4. This circuit uses series inductors 20, 22 with both the transmitter capacitor 21 and the receiver capacitor 23. In addition a style PC250P plug-in code following relay is used for the track relay 24. The use of an inductor in series represents an improvement in that if capacitor 10 at the transmitter end of the circuit of FIG. 4 becomes shorted there will be no current limiting impedance, other than the resistance of the leads, between the source of voltage E and the track. This results in two problems: train detection may be lost, and as the train approaches the leaving end of the track circuit it is possible that the cab signal runby may cause a problem before the current reaches the level at which a fuse (not shown) would blow to protect the track transformer. The insertion of a series inductor 20 in FIG. 6 to serve as a backup limiting impedance in the event of a shorted capacitor 21 overcomes these problems. The value of the series inductor 20 and capacitor 21 are chosen so that at the signaling frequency their combined impedance equals the reactance of the feed end capacitor 10 in FIG. 4. This requires that the resonant frequency of the capacitor inductor pair (20, 21) be higher than the signaling frequency. The value of the resonant frequency, which has no significance, depends on the particular values of the capacitor and inductor; there is an unlimited number of possible pairs that could be used. An available inductor might be chosen, and a capacitor selected to match it. If this is done properly, the degree of cab signal runby suppression with a shorted capacitor can be made acceptable, although inferior to that obtained with the capacitor operating properly. Another benefit to be gained by adding the inductor in series with capacitor 21 is that it provides blocking impedance at audio frequencies where an AF track circuit is overlaid. If such overlay is in the vicinity of the receive end of the track circuit, an inductor 22 should be added in series with the capacitor 23 bridging the track transformer. The capacitor inductor pair (22, 23) is to be chosen so as to have combined impedance which is of the proper capacitive value at the signaling frequency.

Referring to FIG. 6, inductors 20 and 22 might each be 50 ohms at 100 hertz, and capacitors 21 and 23 might each be 10 microfarads.

Figure 7A:
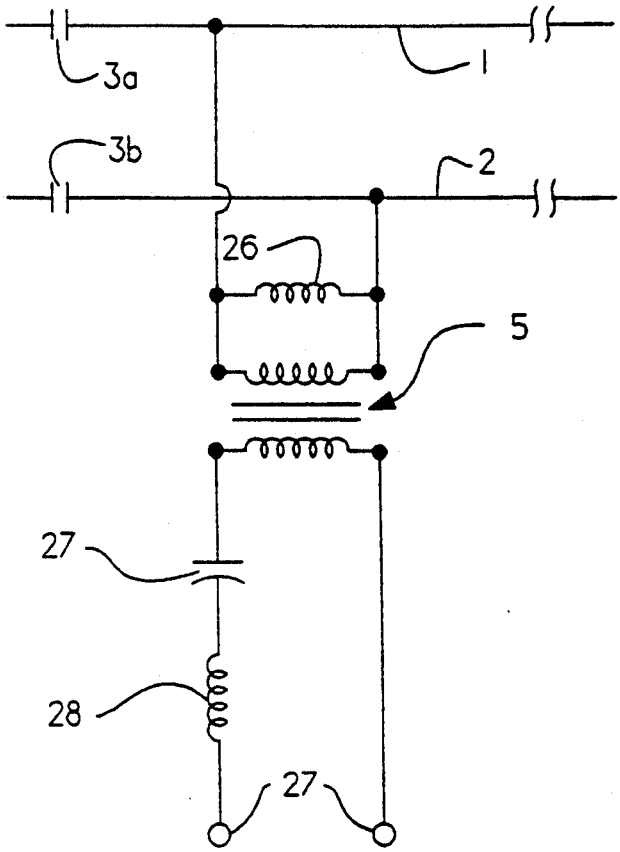
FIGS. 7*a* and 7*b* are two preferred embodiments as may be used on a non-electrified track territory where impedance bonds are not used.
Figure 7B:
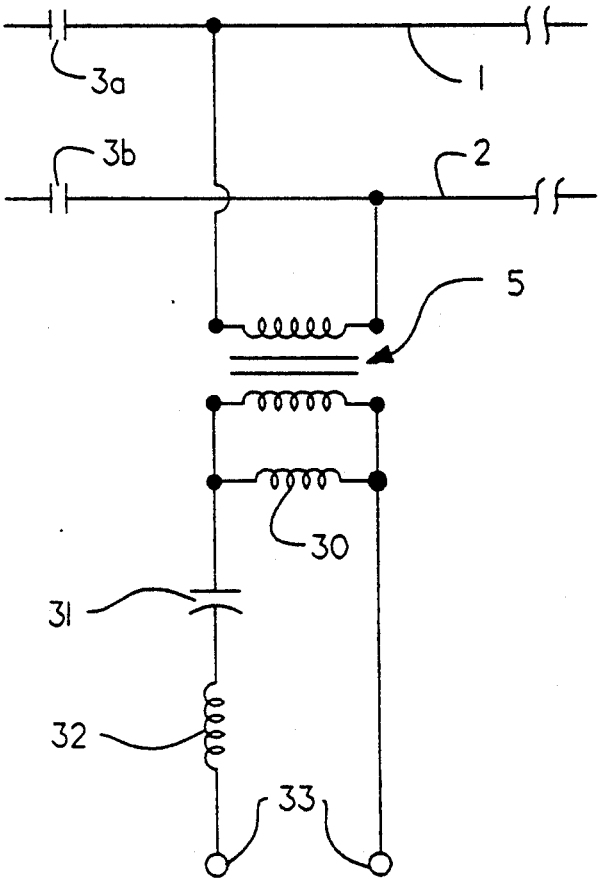

FIGS. 7*a* and 7*b* show two presently preferred embodiments of cab signal transmitting circuits that may be used in non-electrified territory. In non-electrified territory impedance bonds between adjacent track sections are not used, so to provide the constant current source transmitter previously described a separate inductor can be used. In FIG. 7*a* rails 1 and 2 are connected across the secondary of transformer 5. Inductance 26 is also connected across the output secondary of transformer 5. The primary side of transformer 5 is connected to the series arrangement of capacitor 27 and inductor 28 with terminals 29 providing for a CTPR and voltage signal source E as previously shown. Inductor 26 can have an impedance typically about 1 ohm. In fact it can be chosen to be equal to the normal impedance bond or any other desired value. As previously described the values of 26, 27, and 28 are chosen so as to provide the constant current source transmitter equivalent as described in relation to FIG. 3*c*.

FIG. 7*b* shows an embodiment wherein an impedance bond is not used, such as in non-electrified territory, and the inductor 30 is placed on the primary side of transformer 5. Again, values for inductor 30, 32, and 31 are chosen so as to permit the signal source connected to terminal 33 to function as an equivalent constant current source to rails 1 and 2. In some embodiments it may be desirable that inductors 30 and 32 are equal.

When impedance bonds are not used and reactances are to be added to the circuit it is also contemplated that capacitance could be added across the primary or secondary of transformer 5. In this case, series inductance would be added to the signal source so as again to achieve a tuned circuit at the resonant frequency of the code signal.

Although certain preferred embodiments have been described herein, it is to be understood that various other embodiments and modifications can be made within the scope of the following claims.

I claim:

1. An improved railway cab signal transmitter for transmitting a cab signal onto a pair of rails having an impedance bond between said rails at a transmitter end of a track circuit, the transmitter comprising:

a transmitting circuit in parallel arrangement with said impedance bond and having reactance to generally resonate with said impedance bond at a preselected cab signal frequency;

code means for providing a cab signal of said preselected frequency to said transmitting circuit; and said reactance having a value to produce such cab signal having a current generally independent of the position of a track vehicle in said track circuit.

2. The improved railway cab signal transmitter of claim 1 wherein said transmitting circuit includes:

a transformer having a secondary winding in parallel with said impedance bond and a primary winding having a capacitor and said code means in series therewith.

3. The improved railway cab signal transmitter of claim 2 wherein said transmitting circuit further includes an inductor in series with said capacitor and said primary winding.

4. The improved railway cab signal transmitter of claim 1 wherein said transmitting circuit includes a capacitance in parallel with said impedance bond.

5. The improved railway cab signal transmitter of claim 4 wherein said transmitting circuit further includes an inductor in series with said capacitor with such series inductor and capacitor arrangement being in parallel to said impedance bond.

6. An improved railway cab signal transmitter for transmitting a cab signal onto a pair of rails having an impedance bond between said rails at the transmitter end of a track circuit, said transmitter comprising:

a transmitting circuit in parallel to said impedance bond;

a code means for providing an electrical voltage cab signal at a preselected frequency to said transmitting circuit; and the reactance of said transmitting circuit being of a value such that said transmitter supplies said rails as a constant current source to said rails generally independent of the varying electrical load on said rails by the position of a track vehicle.

7. The improved railway cab signal transmitter of claim 6 wherein said transmitting circuit includes:

a transformer having a secondary winding in parallel with said impedance bond and a primary winding with a capacitor and said code means in series therewith.

8. The improved railway cab signal transmitter of claim 7 wherein said transmitting circuit further includes an inductor in series with said capacitor.

9. A railway track cab signal apparatus for connecting to a pair of rails in a track section having a first impedance bond at one end and a second impedance bond at a second end, said track circuit comprising:

a cab signal transmitter connected at said one end having a transmitting circuit in parallel arrangement with said first impedance bond, said transmitting circuit to resonate with said first impedance bond at a preselected cab signal frequency and to produce such cab signal having a current level generally independent of the position of a track vehicle in said track section;

said cab signal transmitter having a code means coupled to said transmitting circuit for providing a cab signal of said predetermined frequency; and a wayside receiver means coupled to said rails at said second end for receiving track signals from said rails.

10. The railway track cab signal apparatus of claim 9 wherein said transmitting circuit includes:

a transformer having a secondary winding in parallel with said first impedance bond and a primary winding with a capacitor and said code means in series therewith.

11. The railway track cab signal apparatus of claim 10 wherein said transmitting circuit further includes an inductor in series with said capacitor and said primary winding.

12. The railway track cab signal apparatus of claim 11 wherein said receiver means includes a receiver transformer having a first winding connected across said second impedance bond and a receiver capacitor connected across a second winding of said receiver transformer.

13. The railway track cab signal apparatus of claim 12 wherein said receiver means further includes a receiver inductor connected in series with said receiver capacitor across the second winding of said receiver transformer.

14. The railway track cab signal apparatus of claim 10 wherein said receiver means includes a receiver transformer having a first winding connected across said second impedance bond and a receiver capacitor connected across a second winding of said receiver transformer.

15. The railway track cab signal apparatus of claim 14 wherein said receiver means further includes a receiver inductor connected in series with said receiver capacitor across the second winding of said receiver transformer.

16. The railway track cab signal apparatus of claim 9 wherein said receiver means includes a receiver transformer having a first winding connected across said second impedance bond and a receiver capacitor connected across a second winding of said receiver transformer.

17. The railway track cab signal apparatus of claim 16 wherein said receiver means further includes a receiver inductor connected in series with said receiver capacitor across the second winding of said receiver transformer.

18. An improved railway track signal transmitter for transmitting a signal onto a pair of rails at a transmitter end of a track circuit, the transmitter comprising:

a transmitting circuit connectable across said rails, said transmitting circuit having a capacitance element and an inductive element connected in parallel, the values of said capacitance element and said inductive element being such that said transmitting circuit is generally resonant at a preselected signal frequency and such that the current value of said signal in said rails is generally independent of the varying load imposed upon said rails by the position of a rail vehicle in said track circuit; and a code means for providing a track signal of said preselected frequency to said transmitting circuit.

* * * * *